US008127376B2

(12) United States Patent
Lee et al.

(10) Patent No.: US 8,127,376 B2
(45) Date of Patent: Mar. 6, 2012

(54) WATER CLOSET COMPRISING VARIABLE SOIL EXHAUST SYSTEM

(75) Inventors: Jong-In Lee, Gyeongsangbuk-do (KR); Bong-Kyun Lim, Seoul (KR)

(73) Assignee: H & G. Co., Ltd., Gyeongsangbuk-do (KR)

( * ) Notice: Subject to any disclaimer, the term of this patent is extended or adjusted under 35 U.S.C. 154(b) by 271 days.

(21) Appl. No.: 12/440,460

(22) PCT Filed: Sep. 13, 2007

(86) PCT No.: PCT/KR2007/004430

§ 371 (c)(1),
(2), (4) Date: Mar. 7, 2009

(87) PCT Pub. No.: WO2008/032989

PCT Pub. Date: Mar. 20, 2008

(65) Prior Publication Data

US 2010/0175177 A1 Jul. 15, 2010

(30) Foreign Application Priority Data

Sep. 14, 2006 (KR) ..... 10-2006-0089126

(51) Int. Cl.
*E03D 11/02* (2006.01)
*E03D 1/01* (2006.01)

(52) U.S. Cl. ..... 4/421; 4/328; 4/344

(58) Field of Classification Search ..... 4/420, 422, 4/423, 424, 426, 428–430, 431, 328, 326, 4/378, 421; 220/669

See application file for complete search history.

(56) References Cited

U.S. PATENT DOCUMENTS 2,456,885 A * 12/1948 Molloy ..... 4/420
4,407,025 A * 10/1983 Hennessy et al. ..... 4/321
2007/0094783 A1 * 5/2007 Wen ..... 4/421

* cited by examiner

*Primary Examiner* — Dinh Nguyen
*Assistant Examiner* — Joel Zhou
(74) *Attorney, Agent, or Firm* — Levine & Mandelbaum

(57) ABSTRACT

A water closet has a variable siphon soil exhaust system with a flexible water bladder connected to a water inlet, a tension spring within the water bladder to contract the water bladder, a variable siphon tube connected to the water bladder to allow soil to be exhausted from the bowl while lifted and lowered by an expanding and contracting motion of the water bladder, and a small tube for connecting the water bladder to the variable siphon tube. A cover has a first port connected to the water supply passage, a second port connected to the bowl, and a third port connected to a bottom tube laid under the floor. The variable siphon tube has one end connected to the bowl through a bellows tube and an opposite freely movable open end communicating with the interior of the cover.

5 Claims, 6 Drawing Sheets

PRIOR ART $(A>A_0)$

WATER CLOSET COMPRISING VARIABLE SOIL EXHAUST SYSTEM

TECHNICAL FIELD

The present invention relates to a water closet, and more particularly, to a water closet comprising a variable soil exhaust system which can improve durability and reduce an amount of flush water.

BACKGROUND ART

A conventional variable siphon water closet has been disclosed in Korean Patent No. 479678. As shown in FIG. 1, the water closet includes a flexible water bladder 5 installed at a rear side of a bowl 1 to be connected to a water supply passage 3; an upper bracket 7 for coupling the water bladder 5 with the water supply passage 3; a lower bracket 9 coupled with a bottom surface of the water bladder 5; tension springs 11 for resiliently connecting both ends of the upper and lower brackets 7 and 9, respectively; a variable siphon tube 13 including one opening end 13*a* connected to a water outlet 1*a* of the bowl 1 through an upper bellows tube 15, another opening end 13*b* connected to a bottom tube 19 through a lower bellows tube 17, and a bent portion 13*c* coupled with the lower bracket 9; and a small tube 21 for connecting the water bladder 5 to the variable siphon tube 13.

However, the aforementioned conventional water closet has the following problems.

1. In the above conventional water closet, the variable siphon tube has a long length (e.g., U shape) and is connected to the bottom tube through the lower bellows tube. Therefore, tension springs with a strong elastic force are essentially required to lift and lower the variable siphon tube. Further, since the tension springs have a strong elastic force, a capacity of the water bladder should be increased such that the springs can be stretched enough to lower the variable siphon tube. Therefore, since a large amount of water discharged from a water tank flows into the large water bladder, an amount of water that should be introduced into the bowl is reduced accordingly, which results in reduction of flushing efficiency of the bowl.

2. In addition, to achieve an aesthetic external appearance, parts installed at the rear side of the bowl are covered with a ceramic material (a class of ceramics). A process of manufacturing a ceramic toilet in this manner has a lower productivity and thus results in increase of the manufacturing costs of products.

3. As shown in FIG. 1, the two springs are installed at both sides, i.e. at two positions, respectively. The elastic forces of the two springs should be the same as each other, if the variable siphon tube can be stably lifted and lowered. If the elastic forces of the two springs are different from each other or there is a difference in installation positions of the springs because the bottom of a water tank of the water closet is not level in a ceramics manufacturing process, the variable siphon tube is unstably lifted and lowered. This causes abnormal wear to the water bladder and the upper and lower bellows tubes installed at both ends of the variable siphon tube 4. Particularly, as shown in FIG. 1, since the springs are installed externally at both sides of the variable siphon tube, a total width of the water bladder and the two springs is relatively large. Therefore, as the width of the water bladder and the two springs is increased, a width of a ceramic cover surrounding the outer periphery thereof is also increased. As a result, the rear portion of the bowl cannot be designed slim, and thus, it is difficult to satisfy a variety of design requests of consumers.

5. The weakest portions of the conventional water closet in view of durability are the bellows tubes where joint motions are continuously performed. A durable material is used to reinforce the weak portions. However, since the lower bellows tube comes into contact with the bottom surface during the lowering motion, it still has a shorter lifespan than the upper bellows tube. That is, the conventional water closet has a durability problem.

DISCLOSURE OF INVENTION

Technical Problem

Accordingly, the present invention is conceived to solve the aforementioned problems in the prior art. An object of the present invention is to provide a variable siphon water closet wherein a size of a variable siphon tube is remarkably reduced to thereby reduce an elastic force of a spring for lifting the variable siphon tube, so that a capacity of a water bladder for serving to stretch the spring can be reduced to almost a half as compared with that of the conventional water closet, whereby an amount of flush water introduced into the water bladder is reduced but a larger amount of flush water is supplied into a bowl to improve an effect of flushing the bowl.

Technical Solution

According to an aspect of the present invention for achieving the object, there is provided a water closet, comprises a variable siphon soil exhaust system including: a flexible water bladder installed at a rear side of a bowl to be connected to a water supply passage, a tension spring for applying an elastic force to contract the water bladder, a variable siphon tube connected to the water bladder via a bracket to allow soil to be exhausted from the bowl while lifted and lowered by an expanding and contracting motion of the water bladder, and a small tube for connecting the water bladder to the variable siphon tube; and a cover installed to surround the soil exhaust system.

Here, the cover is formed by coupling first and second half covers having the same shape and comprises a first port connected to the water supply passage, a second port connected to the bowl, and a third port connected to a bottom tube laid under the floor; the variable siphon tube has one end connected to the bowl through a bellows tube and the other end communicating with the interior of the cover; and the tension spring is installed within the water bladder in such a manner that an upper end thereof is fixed to an upper catching portion installed at an outlet of the water supply passage and a lower end thereof is fixed to a lower catching portion provided on the bracket or a bottom surface of the water bladder.

BEST MODE FOR CARRYING OUT THE INVENTION

Hereinafter, a preferred embodiment of the present invention will be described in detail with reference to the accompanying drawings.

Figure 1:
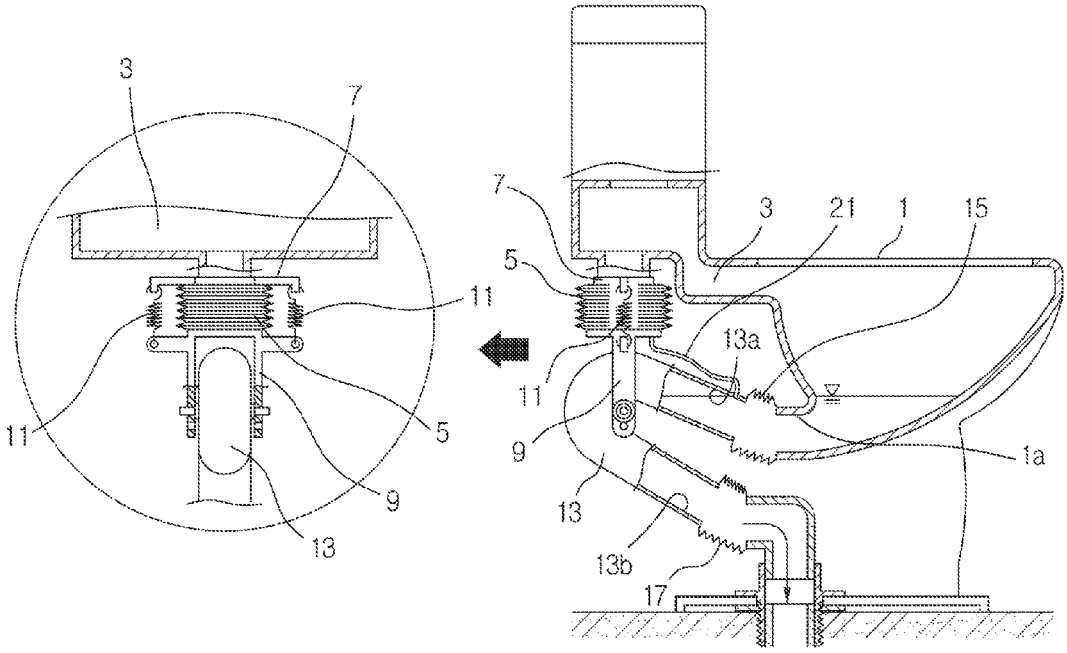
FIG. 1 is a side view of a conventional variable siphon water closet.
Figure 2:
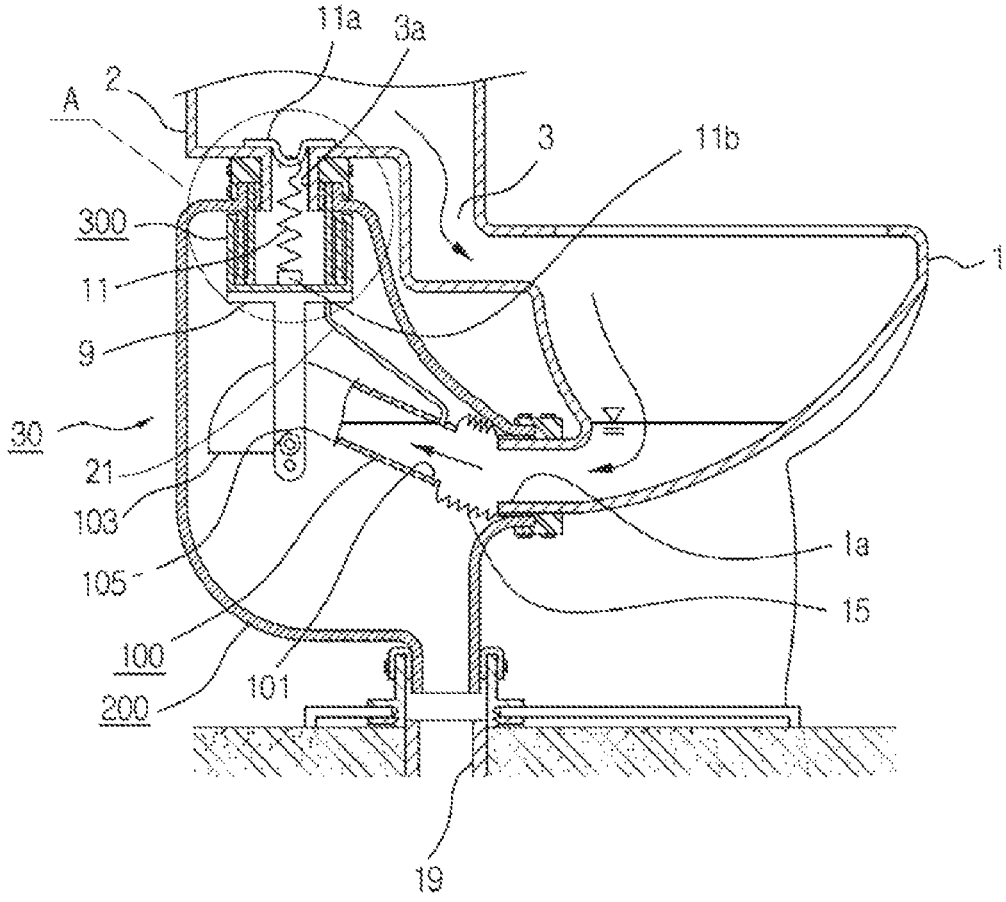
FIG. 2 is a side view illustrating a state before a variable soil exhaust system according to the present invention is operated.
Figure 3:
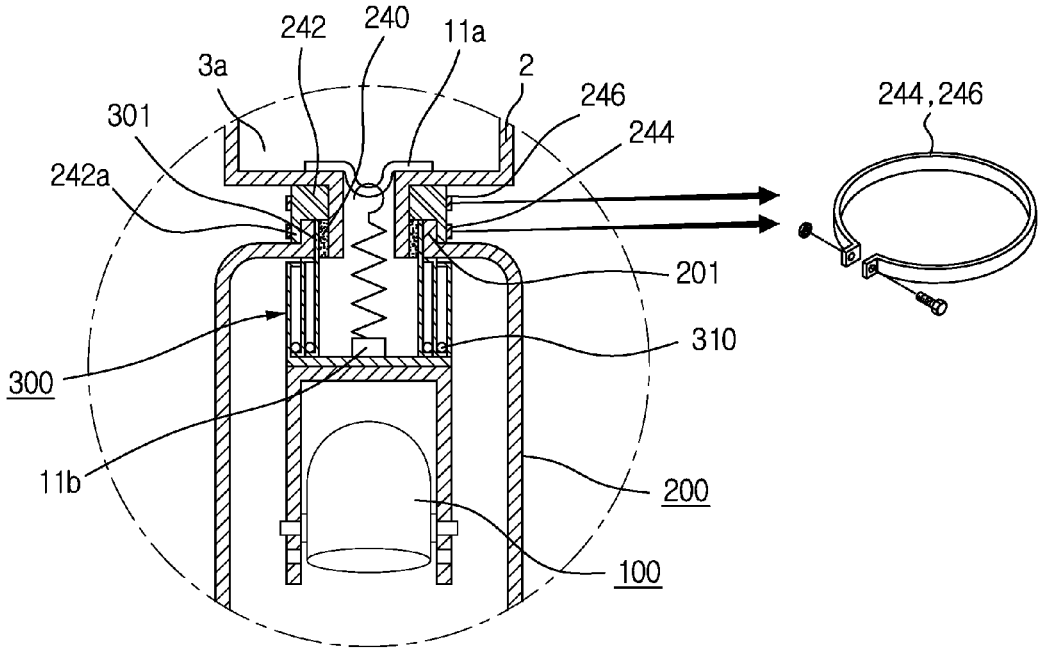
FIG. 3 is an enlarged view of a portion "A" shown in FIG. 2.
Figure 4:
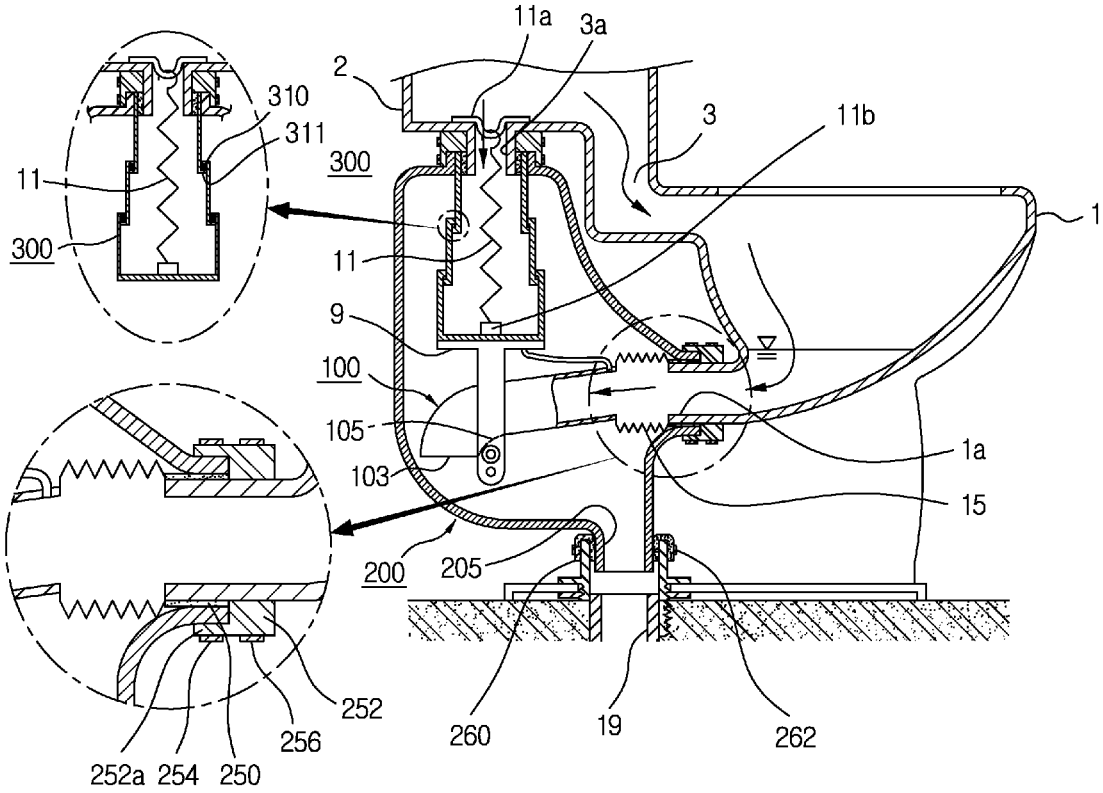
FIG. 4 is a side view illustrating a state after the variable soil exhaust system according to the present invention is operated.

FIG. 2 is a side view illustrating a state before a variable soil exhaust system according to the present invention is operated, and FIG. 3 is an enlarged view of a portion "A" shown in FIG. 2. Further, FIG. 4 is a side view illustrating a state after the variable soil exhaust system according to the present invention is operated.

Figure 5:
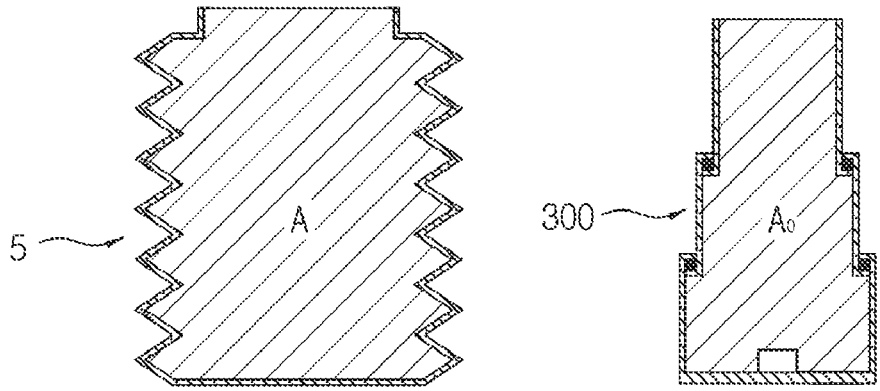
Fig. 5 PRIOR ART
FIG. 5 is a view illustrating capacity comparison between a conventional water bladder and a water bladder of the present invention.
Figure 6:
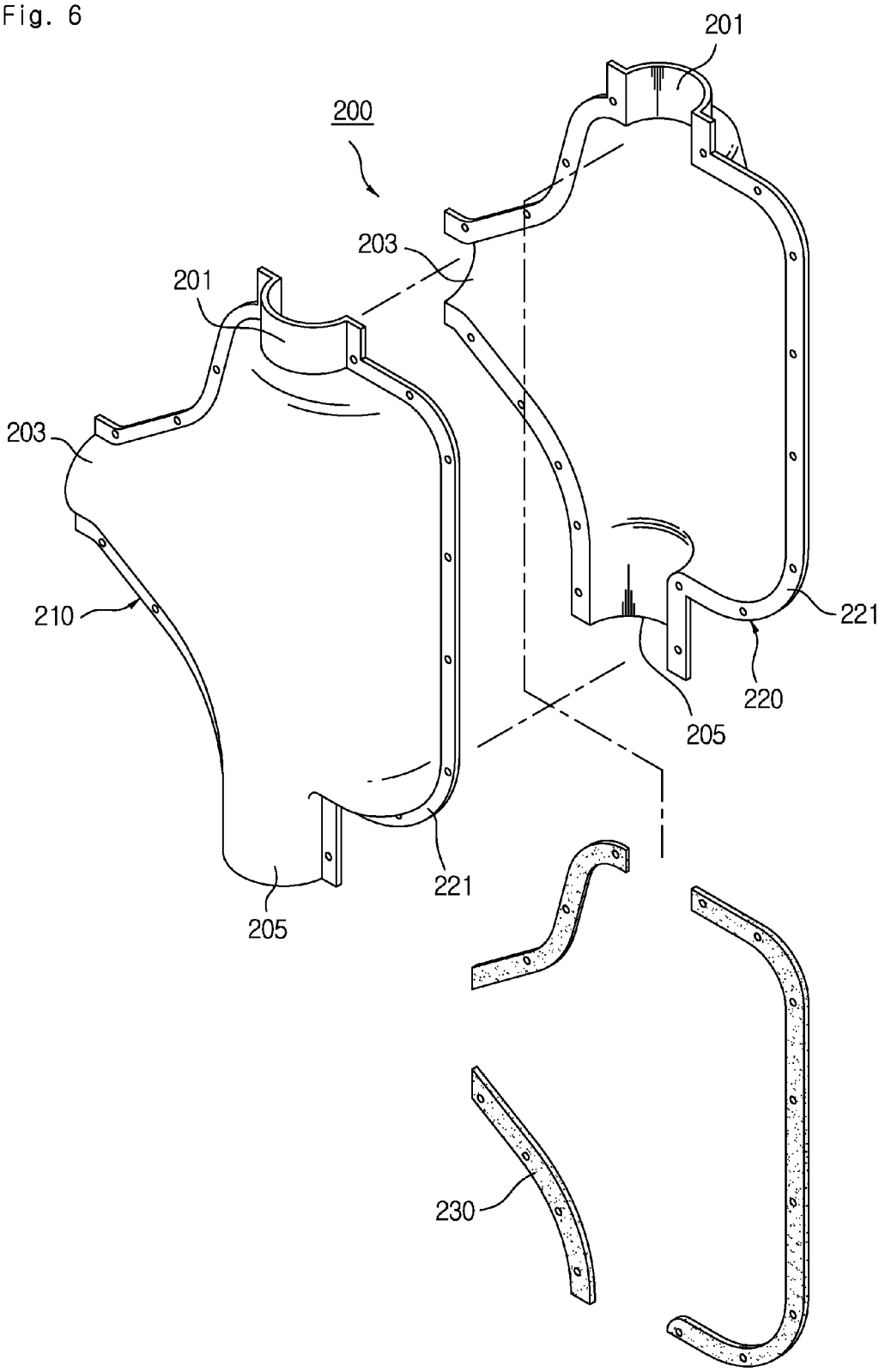
FIG. 6 is an exploded perspective view of a cover of the variable soil exhaust system according to the present invention.

FIG. 5 is a view illustrating capacity comparison between a conventional water bladder and a water bladder of the present invention, and FIG. 6 is an exploded perspective view of a cover of the variable soil exhaust system according to the present invention.

As shown in the figures, the water closet of the present invention comprises a variable siphon soil exhaust system 30 including a flexible water bladder (300) installed at a rear side of a bowl 1 to be connected to a water supply passage 3, a tension spring 11 for applying an elastic force to expand and contract the water bladder, a variable siphon tube 100 connected to the water bladder 300 via a bracket 9 to allow soil to be exhausted from the bowl 1 while lifted and lowered by the expanding and contracting motion of the water bladder 300, and a small tube 21 for connecting the water bladder to the variable siphon tube 100.

In order to reduce weight, the variable siphon tube 100 is configured to take the shape of a straight tube with a length reduced to almost a half as compared with the conventional siphon tube. Therefore, a connection structure of the variable siphon tube 100 is also different from that of the conventional tube. More specifically, an inlet end 101 is connected to a water outlet 1*a* of the bowl 1 via a bellows tube 15 such that an outlet end 103 is moved in horizontal and vertical directions. Further, the outlet end 103 is provided with a curved catching portion 105 such that the siphon tube can be supported on the bracket 9 connected to a bottom surface of the water bladder 300. Here, contrary to the prior art, the outlet end 103 is not connected to a bottom tube 19, and thus, a means for allowing soil exhausted from the outlet end 103 to be guided into the bottom tube 19 is essentially necessary. Therefore, a cover 200 to be explained below serves to guide the soil into the bottom tube 19.

As shown in FIG. 6, the cover 200 is a plastic injection molded product and comprises first and second half covers 210 and 220 with the same shape which in turn are assembled into a barrel shape such that air and water tightness can be maintained. The soil exhaust system 30 is housed in the cover 200. Further, the cover 200 is provided with a first port 201 connected to an outlet 3*a* of the water supply passage 3, a second port 203 connected to the water outlet 1*a* of the bowl 1, and a third port 205 connected to an inlet of the bottom tube 19 laid under the floor. The cover 200 is installed to surround the exterior of the soil exhaust system 30 and also functions as a shield for covering the soil exhaust system 30 to improve an aesthetic external appearance. At the same time, the cover 200 serves to allow the soil exhausted from the outlet end 103 of the variable siphon tube 100 to be guided into the bottom tube 19. Here, a lower portion of the cover 200 is preferably formed into a funnel shape to smoothly guide the soil into the bottom tube 19.

In addition, since soil passes through the cover 200, it is important to maintain the air and water tightness of the cover 200 such that smell generated from the soil and water mixed with the soil cannot be leaked to the outside. Therefore, flange portions 221 for fastening the first and second half covers 210 and 220 with screws should be formed respectively at opposite surfaces where the first and second half covers 210 and 220 are brought into contact with each other, and gaskets 230 with excellent air and water tightness should also be essentially interposed between the flange portions. Further, the respective ports of the cover are configured to maintain the air and water tightness, as follows.

First, the configuration for maintaining the air and water tightness between the first port 201 and the outlet 3*a* of the water supply passage 3 will be described hereinafter.

An upper inlet 301 of the water bladder 300 to be explained later is fitted around an outer circumference of the outlet 3*a* of the water supply passage 3. Here, a first gasket 240 is interposed to prevent smell and water from being leaked from between the outlet 3*a* of the water supply passage 3 and the inlet 301 of the water bladder 300. The first port 201 is fitted around an outer circumference of the inlet 301 of the water bladder 300, and a second gasket 242 is installed at an upper portion of the outer circumference of the outlet 3*a* of the water supply passage 3. An extension portion 242*a* is formed at a lower portion of the second gasket 242 to surround an outer circumference of the first port 201. A first clamp 244 is tightened around an outer circumference of the extension portion 242*a*, and thus, the air and water tightness can be maintained at a region of the first port 201 by means of the first and second gaskets 240 and 242. An outer circumference of the second gasket 242 is clamped by a second clamp 246, and thus, that the air and water tightness can be completely maintained at the first port 201 by means of the first and second gaskets 240 and 242 and the extension portion 242*a* of the second gasket.

The configuration for maintaining the air and water tightness between the second port 203 and the water outlet 1*a* of the bowl 1 will be described hereinafter.

The second port 203 is fitted around a part of an outer circumference of the water outlet la of the bowl 1. A third gasket 250 is interposed to prevent the smell and water from being leaked from between the second port 203 and the water outlet 1*a*. A fourth gasket 252 is further installed at another part of the water outlet la of the bowl 1. An extension portion 252*a* is formed at one side of the fourth gasket to surround an outer circumference of the second port 201. A third clamp 254 is tightened around an outer circumference of the extension portion 252*a*, and thus, the air and water tightness can be maintained at a region of the second port 203 by means of the third and fourth gaskets 250 and 252. An outer circumference of the fourth gasket 252 is clamped by a fourth clamp 256, and thus, the air and water tightness can be completely maintained at a region of the second port 203 by means of the third and fourth gaskets 250 and 252 and the extension portion 252*a* of the fourth gasket 252.

The configuration for maintaining the air and water tightness between the third port 205 and the bottom tube 19 will be described hereinafter.

The third port 205 is fitted into an inner circumference of an inlet of the bottom tube 19. A fifth gasket 260 is then interposed to prevent smell and water from being leaked from between the bottom tube 19 and the third port 205. An outer circumference of the third port 205 is tightened by means of a fifth clamp 262, and thus, the air and water tightness can be maintained at a region of the third port 205 by means of the fifth gasket 260 and the fifth clamp 262.

Meanwhile, the water bladder 300 is also a plastic injection molded product and can be formed into a telescope type or a bellows type which can be folded in a vertical direction. Particularly, the telescope type can be folded in such a manner that smaller sized cylinders are sequentially inserted in larger sized cylinders as performed in an antenna. Therefore, the telescope type has a variable capacity structure in which a capacity is decreased in a folded state but is increased in an extended state. Since water may be leaked from between the adjacent cylinders, a ring-shaped gasket 310 is preferably installed at a connection portion 311 between the adjacent cylinders.

Furthermore, the tension spring 11 is installed within the water bladder 300 in such a manner that an upper end thereof is fixed to an upper catching portion 11*a* installed at the outlet 3*a* of the water supply passage 3 and a lower end thereof is fixed to a lower catching portion 11*b* installed on the bracket 9 or the bottom surface of the water bladder 300.

The operating process of the present invention will be described hereinafter.

If water in a water tank 2 is drained to exhaust soil from the bowl 1 in a state as shown in FIG. 2, an extremely small amount of water is introduced into the small capacity water bladder 300 and the water bladder in a folded state is then expanded due to weight of the introduced water such that a length of the bladder is increased. At the same time, the tension spring 11 is also stretched due to an expansion force of the water bladder 300. Therefore, the outlet end 103 of the variable siphon tube 100 positioned below the water bladder 300 is displaced downwardly as viewed from the figure. At the same time, most amount of water discharged from the water tank 2 is supplied into the bowl 1 along the water supply passage 3 to thereby exhaust the soil from the bowl 1.

When the outlet end 103 of the variable siphon tube 100 is lowered due to the expansion force of the water bladder 300, an internal line of the variable siphon tube 100 is inclined downwardly, and thus, the soil in the bowl 1 and the water supplied in the bowl are discharged to the interior of the cover 200 through the outlet end 103 of the variable siphon tube 100. In this process, when water drainage from the water tank 2 is stopped, water residing in the water bladder 300 is discharged to the variable siphon tube 100 through the small tube 21 as an internal capacity of the variable siphon tube 100 is reduced.

As water in the water bladder 300 is discharged to the variable siphon tube 100 through the small tube 21, weight of the water bladder is gradually decreased. When the weight of the water bladder is decreased, an elastic force of the tension spring 11 becomes gradually dominant. As a result, the water bladder is reduced to an original size and the outlet end 103 of the variable siphon tube 100 is also lifted due to the elastic force of the tension spring 11. As explained above, since the capacity of the water bladder 300 is smaller than that of the conventional water bladder, the outlet is more rapidly lifted as compared with the conventional one, and thus, a lifting timing of the variable siphon tube 100 is also faster. In the conventional variable water closet, water in the water bladder becomes residual water (reservoir water) in the bowl. In the present invention, however, the variable siphon tube 100 is more rapidly lifted as compared with the conventional one, and thus, water in the water bladder 300 and water in the bowl 1 which has not yet been drained are left as residual water (reservoir water) of the bowl.

The scope of the present invention is not limited to the embodiment described and illustrated above but is defined by the appended claims. It will be apparent that those skilled in the art can make various modifications and changes thereto within the scope of the invention defined by the claims. Therefore, the true scope of the present invention should be defined by the technical spirit of the appended claims.

INDUSTRIAL APPLICABILITY

As discussed earlier, according to the present invention, an elastic force of a spring for lifting a variable siphon tube can be reduced by remarkably decreasing a size (capacity) of the variable siphon tube as compared with the conventional siphon tube. Therefore, a capacity of a water bladder serving to stretch the spring can also be reduced to almost a half as compared with the conventional bladder. As a result, an amount of flush water supplied to the water bladder is reduced and an amount of flush water supplied to the bowl is increased. Thus, an effect of flushing the bowl can be improved, costs of components can be reduced, and a rear design of a water closet can also be diversified due to the size reduction of the water bladder.

In addition, since only a single tension spring is installed within the water bladder, the variable siphon tube can be stably lifted and lowered while the spring is stretched and compressed. Due to the reduced number of components, cost reduction can be achieved.

Further, since a cover is made of a plastic material, cost reduction can also be achieved as compared in the ceramic cover.

Furthermore, since the tension spring is installed within the water bladder, an external catching portion for spring is not required, and thus, a width of the cover can be considerably decreased. Therefore, the cover can be designed slim and the rear design of the water closet can also be diversified.

Moreover, the weakest portions of the conventional water closet in view of durability have been the bellows tubes where joint motions are continuously performed. In particular, since the lower bellows tube (a connection portion between a siphon tube and a bottom tube) comes into contact with the bottom surface during the lowering motion of the siphon tube, its lifespan was shortened as compared with that of the upper bellows tube. However, since the lower bellows tube is not necessary, the durability of the water closet can be improved.

The invention claimed is:

1. A water closet, comprising:

a variable siphon soil exhaust system including: a flexible water bladder installed at a rear side of a bowl to be connected to a water supply passage, a tension spring for applying an elastic force to contract the water bladder, a variable siphon tube connected to the water bladder via a bracket to allow soil to be exhausted from the bowl while lifted and lowered by an expanding and contracting motion of the water bladder, and a small tube for connecting the water bladder to the variable siphon tube; and a cover installed to surround the soil exhaust system, wherein the cover is formed by coupling first and second half covers having the same shape and comprises a first port connected to the water supply passage, a second port connected to the bowl, and a third port connected to a bottom tube laid under the floor;

the variable siphon tube has one end connected to the bowl through a bellows tube and an open opposite end disconnected from the bottom tube and freely movable in horizontal and vertical directions within the interior of the cover; and the tension spring is installed with an upper end thereof fixed to an upper catching portion installed at an outlet of the water supply passage and a lower end thereof is fixed to a lower catching portion provided on the bracket or a bottom surface of the water bladder.

2. The water closet as claimed in claim 1, wherein the water bladder is formed in a telescope type and comprises a plurality of cylinders that nest within one another as the bladder is contracted.

3. The water closet as claimed in claim 1, wherein the variable siphon tube is formed into a straight line shape on one side of the bracket and the open opposite end is on an opposite side of the bracket.

4. The water closet as claimed in claim 1, wherein the cover has an interior contour which guides soil exhausted from the open end of the siphon tube into the bottom tube.

5. The water closet as claimed in claim 1, wherein at least a portion of the tension spring is disposed within the bladder.

* * * * *